US010711562B2

(12) United States Patent
Stæhr

(10) Patent No.: US 10,711,562 B2
(45) Date of Patent: Jul. 14, 2020

(54) ANNULAR BARRIER WITH EXPANSION UNIT

(71) Applicant: Welltec Oilfield Solutions AG, Zug (CH)

(72) Inventor: Lars Stæhr, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 202 days.

(21) Appl. No.: 15/566,068

(22) PCT Filed: Apr. 29, 2016

(86) PCT No.: PCT/EP2016/059587
§ 371 (c)(1),
(2) Date: Oct. 12, 2017

(87) PCT Pub. No.: WO2016/174191
PCT Pub. Date: Nov. 3, 2016

(65) Prior Publication Data

US 2018/0128075 A1 May 10, 2018

(30) Foreign Application Priority Data

Apr. 30, 2015 (EP) ..... 15166050

(51) Int. Cl.
*E21B 33/127* (2006.01)
*E21B 33/12* (2006.01)
(Continued)

(52) U.S. Cl.
CPC ..... *E21B 33/127* (2013.01); *E21B 33/1208* (2013.01); *E21B 33/1277* (2013.01);
(Continued)

(58) Field of Classification Search
CPC .... E21B 33/127; E21B 33/1277; E21B 34/10; E21B 33/1294; E21B 33/1285; E21B 33/1243; E21B 2034/002; E21B 33/1208
See application file for complete search history.

(56) References Cited

U.S. PATENT DOCUMENTS 2,786,535 A * 3/1957 Boer ..... E21B 21/10 166/142
3,272,517 A * 9/1966 Howard ..... E21B 33/1208 277/333
(Continued)

FOREIGN PATENT DOCUMENTS

CN 103732851 A 4/2014
EP 0 275 612 A1 7/1988
(Continued)

OTHER PUBLICATIONS

International Search Report and Written Opinion of the ISA for PCT/EP2016/059587, dated Sep. 6, 2016, 14 pages.
(Continued)

*Primary Examiner* — David J Bagnell
*Assistant Examiner* — Jonathan Malikasim
(74) *Attorney, Agent, or Firm* — Nixon & Vanderhye P.C.

(57) ABSTRACT

An annular barrier to be expanded in an annulus between a well tubular structure and a wall of a borehole downhole includes a tubular metal part having a first expansion opening, an axial extension and an outer face, an expandable sleeve surrounding the tubular metal part and having an inner face facing the tubular metal part and an outer face facing the wall of the borehole, each end of the expandable sleeve being connected with the tubular metal part, and an annular space between the expandable sleeve and the tubular metal part. Fluid inside the tubular metal part has a tubular pressure, and the annular barrier has an expansion unit having a first inlet in fluid communication with the expan-
(Continued)

sion opening, a second inlet in fluid communication with the first zone and an outlet in fluid communication with the annular space. The expansion unit has an element movable at least between a first position in which the expansion opening is in fluid communication with the outlet and the tubular pressure being higher than the first pressure, and a second position in which the outlet is in fluid communication with the first zone and the first pressure being higher than the tubular pressure. The tubular metal part has at least one second expansion opening being fluidly connected with the first inlet.

14 Claims, 8 Drawing Sheets

(51) Int. Cl.

| | |
|---|---|
| ***E21B 34/10*** | (2006.01) |
| ***E21B 33/124*** | (2006.01) |
| ***E21B 33/128*** | (2006.01) |
| ***E21B 33/129*** | (2006.01) |
| ***E21B 34/00*** | (2006.01) |

(52) U.S. Cl.
CPC ..... *E21B 34/10* (2013.01); *E21B 33/1243* (2013.01); *E21B 33/1285* (2013.01); *E21B 33/1294* (2013.01); *E21B 2034/002* (2013.01)

(56) References Cited

U.S. PATENT DOCUMENTS

| | | | | |
|---|---|---|---|---|
| 4,653,588 | A | 3/1987 | White | |
| 5,271,461 | A * | 12/1993 | Decker | E21B 23/006 166/185 |
| 5,400,855 | A | 3/1995 | Stepp et al. | |
| 5,564,501 | A * | 10/1996 | Strattan | E21B 33/0355 166/321 |
| 6,273,195 | B1 * | 8/2001 | Hauck | E21B 33/127 166/129 |
| 6,659,184 | B1 | 12/2003 | Tips et al. | |
| 7,273,107 | B2 * | 9/2007 | Hiron | E21B 34/08 166/373 |
| 7,387,157 | B2 | 6/2008 | Gambier et al. | |
| 2005/0061520 | A1 * | 3/2005 | Surjaatmadja | E21B 33/127 166/387 |
| 2006/0042801 | A1 | 3/2006 | Hackworth et al. | |
| 2014/0190683 | A1 | 7/2014 | Hallunbæk et al. | |
| 2014/0332232 | A1 | 11/2014 | Hallundbæk et al. | |

FOREIGN PATENT DOCUMENTS

| | | | | |
|---|---|---|---|---|
| EP | 2 607 614 | A1 | 6/2013 | |
| FR | 2 988 126 | A1 | 9/2013 | |
| RU | 2 074 306 | C1 | 2/1997 | |
| RU | 2 387 802 | C1 | 4/2010 | |
| SU | 926238 | A1 | 5/1982 | |
| WO | WO2013030284 | A1 * | 3/2013 | E21B 33/127 |

OTHER PUBLICATIONS

Extended Search Report for EP15166050.3, dated Feb. 4, 2016, 9 pages.
English translation of Notification of the First Office Action dated May 8, 2019 in Chinese Application No. 201680022319.1, 9 pages.
Office Action of Substantive Examination dated Sep. 12, 2019 in Russian Application No. 2017138954/03(067892), with English translation, 18 pages.

* cited by examiner

ANNULAR BARRIER WITH EXPANSION UNIT

This application is the U.S. national phase of International Application No. PCT/EP2016/059587 filed 29 Apr. 2016, which designated the U.S. and claims priority to EP Patent Application No. 15166050.3 filed 30 Apr. 2015, the entire contents of each of which are hereby incorporated by reference.

FIELD OF THE INVENTION

The present invention relates to an annular barrier to be expanded in an annulus between a well tubular structure and a wall of a borehole downhole for providing zone isolation between a first zone having a first pressure and a second zone. Furthermore, the invention relates to a downhole system.

BACKGROUND ART

When completing a well, production zones are provided by submerging a casing string having annular barriers into a borehole or a casing of the well. When the casing string is in the right position in the borehole or in another casing in the borehole, the annular barriers are expanded or inflated. The annular barriers are in some completions expanded by pressurised fluid, which requires a certain amount of additional energy. In other completions, a compound inside the annular barrier is heated, so that the compound becomes gaseous, hence increasing its volume and thus expanding the expandable sleeve.

In order to seal off a zone between a well tubular structure and the borehole or an inner tubular structure and an outer tubular structure, a second annular barrier is used. The first annular barrier is expanded on one side of the zone to be sealed off, and the second annular barrier is expanded on the other side of that zone, and in this way, the zone is sealed off.

After being expanded, annular barriers may be subjected to a continuous pressure or a periodically high pressure from the outside, either in the form of hydraulic pressure within the well environment or in the form of formation pressure. In some circumstances, such pressures may cause the annular barrier to collapse, which may have severe consequences for the zone which is to be sealed off by the annular barrier, as the sealing properties are then lost due to the collapse. A similar problem may arise when the expandable sleeve is expanded by an expansion means, e.g. pressurised fluid. If the fluid leaks from the sleeve, the back pressure may fade, and the sleeve itself may thereby collapse.

The ability of the expanded sleeve of an annular barrier to withstand the collapse pressure is thus affected by many variables, such as strength of material, wall thickness, surface area exposed to the collapse pressure, temperature, well fluids, etc.

A collapse rating currently achievable for the expanded sleeve within certain well environments is insufficient for all well applications. Thus, it is desirable to increase the collapse rating to enable annular barriers to be used in all wells, specifically in wells with a high drawdown pressure during production and depletion. The collapse rating may be increased by increasing the wall thickness or the strength of the material; however, this would increase the expansion pressure, which, as already mentioned, is not desirable.

SUMMARY OF THE INVENTION

It is an object of the present invention to wholly or partly overcome the above disadvantages and drawbacks of the prior art. More specifically, it is an object to provide an improved simple annular barrier which is easy to expand and does not collapse, without having a complex anti-collapse system.

The above objects, together with numerous other objects, advantages and features, which will become evident from the below description, are accomplished by a solution in accordance with the present invention by an annular barrier to be expanded in an annulus between a well tubular structure and a wall of a borehole downhole for providing zone isolation between a first zone having a first pressure and a second zone, the annular barrier comprising:

- a tubular metal part for mounting as part of the well tubular structure, the tubular metal part having a first expansion opening, an axial extension and an outer face,
- an expandable sleeve surrounding the tubular metal part and having an inner face facing the tubular metal part and an outer face facing the wall of the borehole, each end of the expandable sleeve being connected with the tubular metal part, and
- an annular space between the inner face of the expandable sleeve and the tubular metal part, the annular space having a space pressure, wherein fluid inside the tubular metal part has a tubular pressure, and wherein the annular barrier comprises an expansion unit having a first inlet in fluid communication with the expansion opening, a second inlet in fluid communication with the first zone and an outlet in fluid communication with the annular space, and the expansion unit comprising an element movable at least between a first position and a second position, in the first position the expansion opening being in fluid communication with the outlet and the tubular pressure being higher than the first pressure, and in the second position the outlet being in fluid communication with the first zone and the first pressure being higher than the tubular pressure, wherein the tubular metal part comprises at least one second expansion opening being fluidly connected with the first inlet.

The expansion unit may comprise a collection part fluidly connected to the first expansion opening and the second expansion opening.

Said collection part may be arranged outside the tubular metal part.

Moreover, the collection part may comprise a collection sleeve arranged outside the tubular metal part and connected to the tubular metal part, forming an annular chamber between the tubular metal part and the collection sleeve.

Further, the first expansion opening and the second expansion opening may be fluidly connected to the annular chamber, and the first inlet may be fluidly connected to the annular chamber.

Also, one or more groove(s) may be arranged in the collection sleeve and/or the tubular metal part facing the annular chamber.

Furthermore, the collection sleeve may have an outer sleeve face in which one or more circumferential groove(s) may be arranged.

The outer sleeve face may have one or more longitudinal groove(s) along the axial extension.

Moreover, the one or more longitudinal groove(s) may be in fluid communication with the second inlet.

Further, a filtering element, such as a slotted or perforated plate, may be arranged between the tubular metal part and the collection sleeve and configured to filtrate the fluid from inside the tubular metal part.

Additionally, the expansion unit may comprise a shuttle valve and the element of the expansion unit may be comprised in the shuttle valve.

Also, the element of the expansion unit may move in the axial extension or radially perpendicular to the axial extension.

Furthermore, the expansion unit may comprise a plurality of first inlets.

In addition, the expansion unit may comprise a plurality of second inlets.

The present invention also relates to an annular barrier to be expanded in an annulus between a well tubular structure and a wall of a borehole downhole for providing zone isolation between a first zone having a first pressure and a second zone, the annular barrier comprising:

a tubular metal part for mounting as part of the well tubular structure, the tubular metal part having a first expansion opening, an axial extension and an outer face, an expandable sleeve surrounding the tubular metal part and having an inner face facing the tubular metal part and an outer face facing the wall of the borehole, each end of the expandable sleeve being connected with the tubular metal part, and an annular space between the inner face of the expandable sleeve and the tubular metal part, the annular space having a space pressure, wherein fluid inside the tubular metal part has a tubular pressure, and wherein the annular barrier comprises an expansion unit having a first inlet in fluid communication with the expansion opening, a second inlet in fluid communication with the first zone and an outlet in fluid communication with the annular space, and the expansion unit comprising an element movable at least between a first position and a second position, in the first position the expansion opening being in fluid communication with the outlet and the tubular pressure being higher than the first pressure, and in the second position the outlet being in fluid communication with the first zone and the first pressure being higher than the tubular pressure, wherein the expandable sleeve has an expandable sleeve opening opposite the expansion opening, the expansion unit being arranged both in the expansion opening and the expandable sleeve opening, so that the outlet is arranged in the annular space.

The expansion unit may be arranged on the outer face of the tubular metal part or on an outer face of the well tubular structure.

Moreover, the expansion unit may be arranged adjacent to or in abutment with the expandable sleeve.

One or both of the ends of the expandable sleeve may be connected with the tubular metal part by means of connection parts, and the expansion unit may be arranged outside the annular space adjacent to or in the connection part.

Further, the outlet of the expansion unit may be fluidly connected to the annular space through a fluid channel.

Furthermore, the expansion unit may be arranged in the first or the second zone being a production zone.

Also, the element may be a piston movable in a piston housing between the first position and the second position, the piston housing comprising a spring being compressed when the piston moves in a first direction.

Additionally, the element may be a ball movable between a first seat when the element is in the first position and a second seat when the element is in the second position.

The outlet may be arranged between the first seat and the second seat.

Moreover, the shuttle valve may have a housing having a first and a second seat made of metal, ceramics, an elastomeric material or a polymeric material.

The present invention also relates to a downhole system comprising:

a well tubular structure, and a first annular barrier according to the present invention.

The downhole system as described above may further comprise a second annular barrier which, when expanded, isolates a production zone together with the first annular barrier, the expansion units of the first annular barrier and the second annular barrier being arranged in a zone other than the production zone.

Finally, the present invention also relates to an expansion method for providing and maintaining zone isolation between a first zone having a first pressure and a second zone having a second pressure of the borehole, the method comprising the steps of mounting an annular barrier as described above as part of a well tubular structure, providing pressurised fluid in through the expansion opening(s), arranging the element in the first position, the first position being the expansion position, so that the pressurised fluid is allowed to flow into the annular space, expanding the expandable sleeve of the annular barrier to provide zone isolation between the first zone and the second zone of the borehole, and maintaining zone isolation between the first zone and the second zone when the first pressure of the first zone is higher than the space pressure by arranging the element in the second position, whereby the second inlet is in fluid communication with the outlet.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
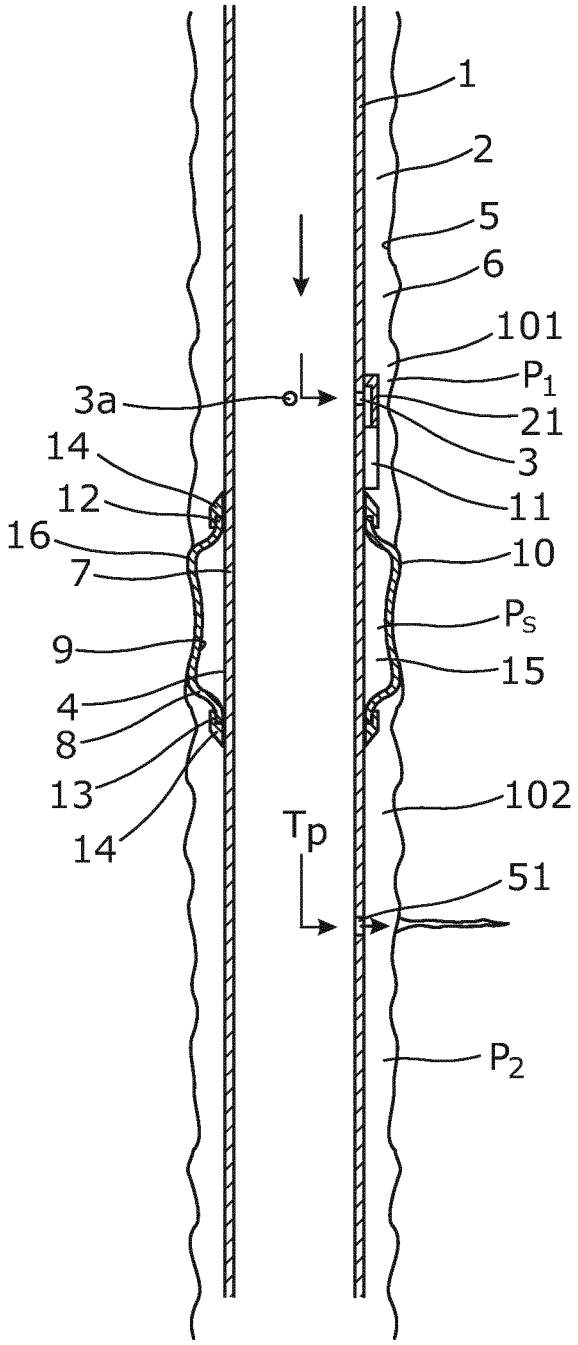
FIG. 1 shows a cross-sectional view of an annular barrier in a well, said annular barrier having an expansion unit.

FIG. 1 shows an annular barrier 10 expanded in an annulus 2 between a well tubular structure 1 and an inside wall 5 of a borehole 6 downhole for providing zone isolation between a first zone 101 and a second zone 102 of the borehole 6. The pressure inside the first zone 101 will from hereon be denoted the first pressure $P_1$, and the pressure inside the second zone 102 will from hereon be denoted the second pressure $P_2$.

The annular barrier 10 comprises a tubular metal part 7 for mounting as part of the well tubular structure 1 and an expandable sleeve 8 surrounding the tubular metal part 7. The tubular metal part 7 has a tubular pressure $T_p$ and a first expansion opening 3. The expandable sleeve 8 has an inner face 9 facing the tubular metal part 7 and an outer face 16 facing the inside wall 5 of the borehole 6. A first end 12 and a second end 13 of the expandable sleeve 8 are connected with the tubular metal part 7 defining an annular space 15 between the expandable sleeve 8 and the tubular metal part 7. The annular space 15 has a space pressure $P_s$. The annular barrier 10 further comprises an expansion unit 11.

Figure 2:
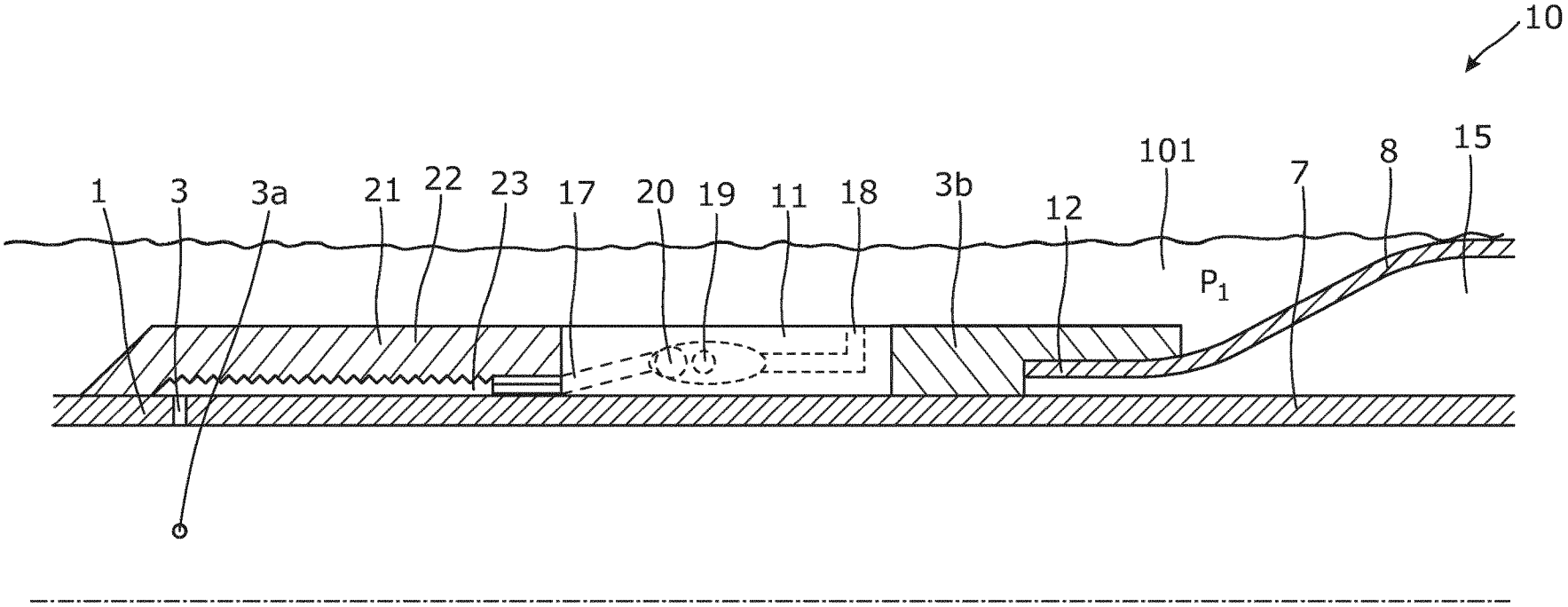
FIG. 2 shows a cross-sectional view of part of another annular barrier.

As shown in FIG. 2, the expansion unit 11 has a first inlet 17 being in fluid communication with the expansion opening 3, a second inlet 18 being in fluid communication with the first zone 101 and an outlet 19 in fluid communication with the annular space 15. The expansion unit 11 comprises an element 20 movable at least between a first position and a second position. In the first position, the expansion opening 3 is in fluid communication with the outlet 19 and the tubular pressure is higher than the first pressure $P_1$. In the second position, the outlet 19 is in fluid communication with the first zone 101 and the first pressure $P_1$ is higher than the tubular pressure, wherein the tubular metal part 7 comprises at least one second expansion opening 3*a* being fluidly connected with the first inlet 17.

The annular barrier 10 may be expanded by means of pressurised fluid from within the well tubular structure 1. When expanding the expandable sleeve 8 of the annular barrier 10, the pressurised fluid in the well tubular structure 1 enters the annular space 15 through the first inlet 17 of the expansion unit 11. If the element 20 is not positioned in expansion mode and thus in the first position, the pressurised fluid presses the element 20 to move, providing access to the outlet 19 fluidly connected with the annular space 15.

After expanding the expandable sleeve 8 of the annular barrier 10, the second pressure $P_2$ in the second zone 102 being the production zone may increase, e.g. during fracturing or production. During fracturing or production, the pressure inside the tubular metal part 7 increases just as during expansion, forcing the pressure inside the tubular metal part 7 to increase, and forcing the space pressure $P_s$ to increase accordingly, so that the pressure inside the tubular metal part 7 and the pressure inside the annular space is substantially the same, thus avoiding collapse of the expandable sleeve 8. During fracturing, the well tubular structure 1 is pressurised and fluid is let out through a production opening 51 in the well tubular structure 1, as indicated by arrows in FIG. 1.

If the first pressure $P_1$ of the first zone 101 subsequently becomes higher than the second pressure $P_2$ in the production zone 102 (shown in FIG. 1), the expansion unit 11 moves to the second position in which the outlet 19 (shown in FIG. 2) is in fluid communication with the first zone 101 and the first pressure $P_1$ is higher than the tubular pressure, providing fluid communication with the annular space 15.

Figure 8:
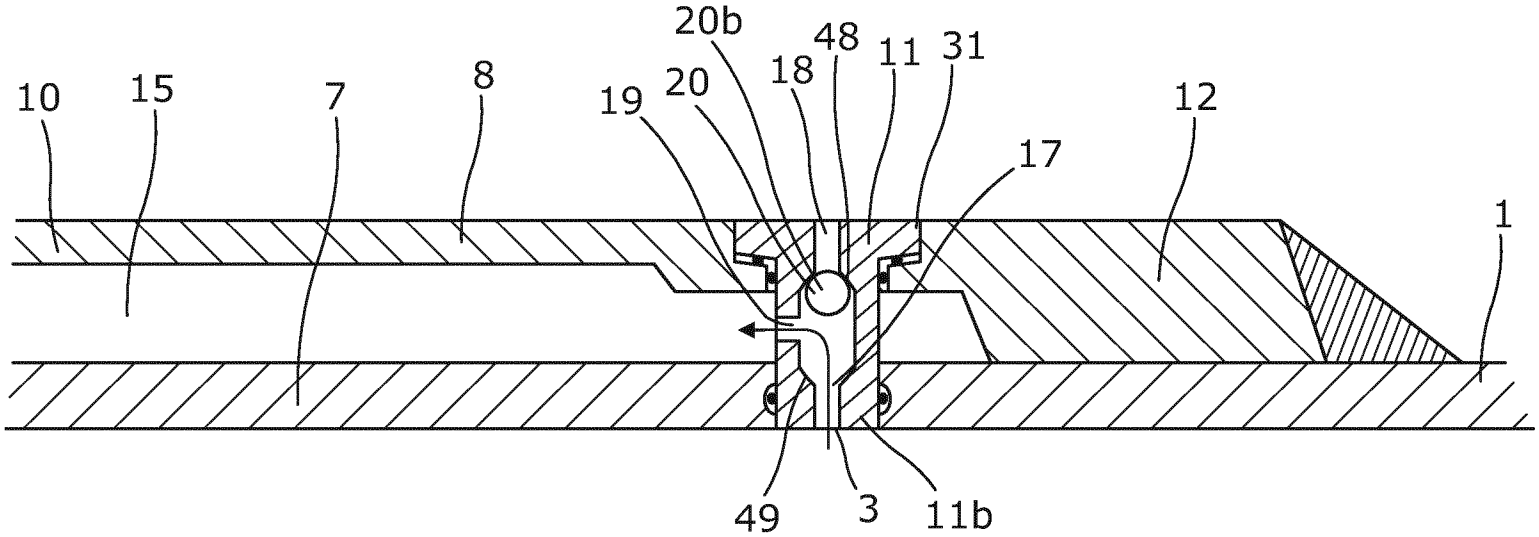
FIG. 8 shows a cross-sectional view of part of another annular barrier.

In FIG. 1, the expandable sleeve 8 is connected with the tubular metal part 7 by means of connection parts 14, so that the expandable sleeve 8 is squeezed between the connection parts and the tubular metal part 7. In another embodiment, the expandable sleeve 8 is welded to the tubular metal part 7, as shown in FIG. 8. The expansion unit 11 comprises a collection part 21 fluidly connected to the first and the second expansion openings 3, 3*a*. The collection part 21 is arranged outside the tubular metal part 7, so that it does not limit the inner diameter of the well tubular structure.

As shown in FIG. 2, the collection part 21 comprises a collection sleeve 22 arranged outside the tubular metal part 7 and connected to the tubular metal part forming an annular chamber 23 between the tubular metal part and the collection sleeve. The first and second expansion openings 3, 3*a* in the tubular metal part 7 are arranged substantially in the same cross-sectional plane along the circumference of the tubular metal part. The tubular metal part 7 may have a plurality of expansion openings arranged opposite the annular chamber. The expansion openings may be arranged with a mutual distance between them along the circumference and along the longitudinal extension of the tubular metal part. The first and the second expansion openings 3, 3*a* are fluidly connected to the annular chamber 23, so that fluid from the tubular metal part flows in through the expansion openings and into the annular chamber and from the annular chamber into the first inlet 17 in the expansion unit 11. The annular chamber 23 is thus fluidly connected to the first inlet 17 of the expansion unit 11. In the expansion unit 11, the pressurised fluid is let further out of the outlet 19 and into the annular space 15 through a conduit. The collection sleeve 22 has grooves 25, 26 (shown in FIG. 6) facing the annular chamber 23 and easing the flow from the expansion openings 3, 3*a* to the first inlet 17. The grooves may, in another embodiment, be arranged in the tubular metal part 7.

Figure 3:
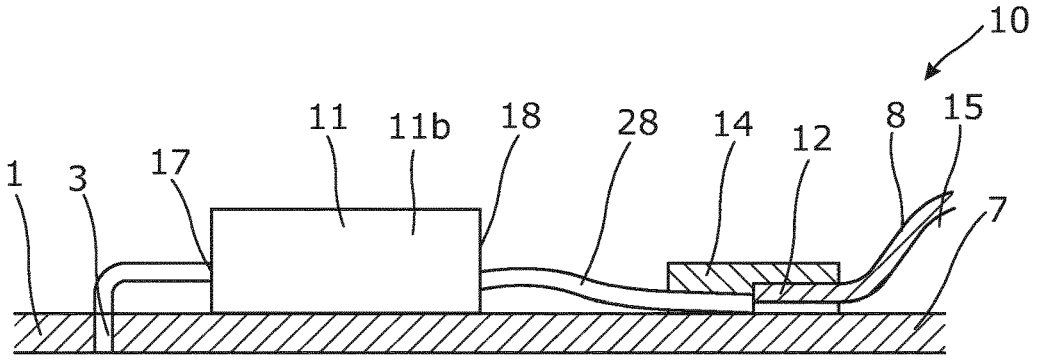
FIG. 3 shows a cross-sectional view of part of another annular barrier.
Figure 4:
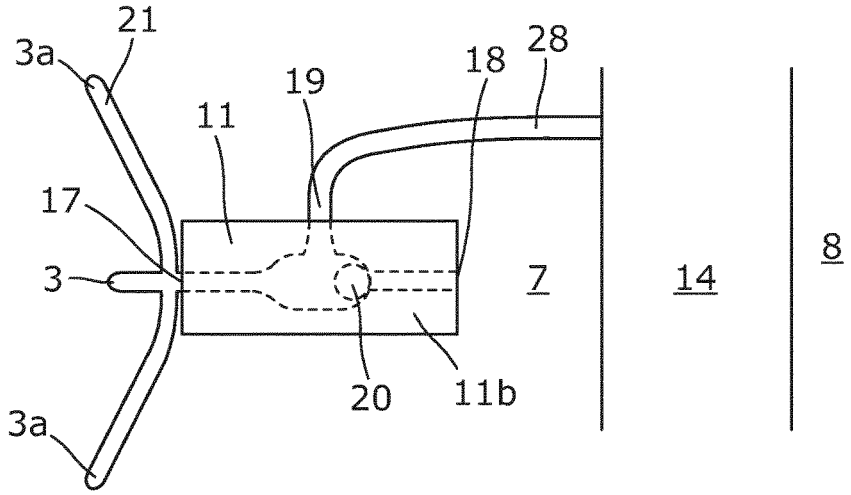
FIG. 4 shows the annular barrier of FIG. 3, seen from outside the annular barrier, the expansion unit being in its first position.
Figure 5:
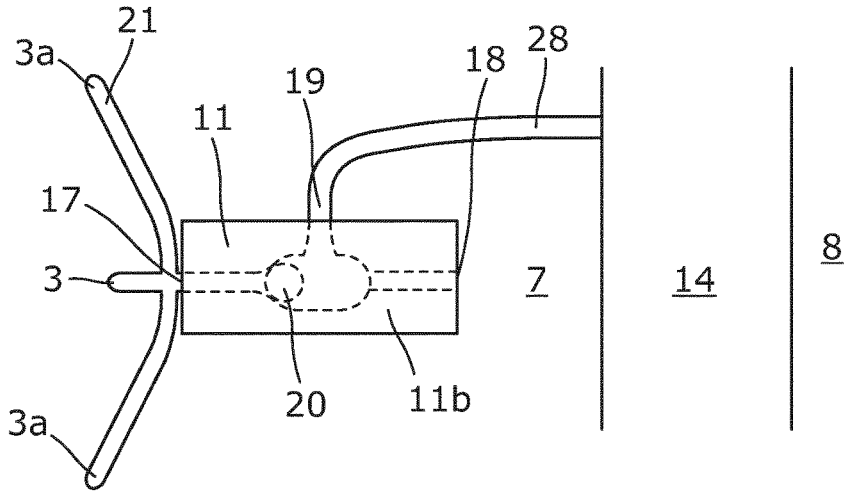
FIG. 5 shows the annular barrier of FIG. 4, the expansion unit being in its second position.

In FIGS. 3-5, the collection part 21 is a conduit joint having three conduit branches, each being connected to an expansion opening 3, 3*a* and joining the fluid from the tubular metal part 7 before the fluid is led into the first inlet 17 of the expansion unit 11. The outlet 19 of the expansion unit 11 is fluidly connected with the annular space 15 through a conduit 28 running through the connection part 14. In FIG. 4, the expansion unit 11 is positioned in the first position, in which the element 20 is forced against and blocks the second inlet 18, so that a fluid path between the first inlet 17 and the outlet 19 is created. In FIG. 5, the element 20 has shifted position to the second position, in which the element has been forced against and closes the first inlet 17, so that a fluid path between the second inlet 18 and the outlet 19 is provided, equalising the pressure in the first zone with the space pressure in the annular space. Stated differently, the space pressure is equalized with the greater momentary pressure of the first pressure and the tubular pressure at a first time, even if the space pressure at a second time later than the first time is less than the greater momentary pressure. The expansion unit 11 of FIGS. 3-5 comprises a shuttle valve 11*b* where the element is part of the shuttle valve shuttling back and forth between the first position and the second position, depending on the pressure inside the tubular metal part, the space pressure and the first pressure in the first zone. The element 20 of the expansion unit 11 moves in the axial extension but may, in another embodiment, move radially perpendicular to the axial extension.

Figure 6:
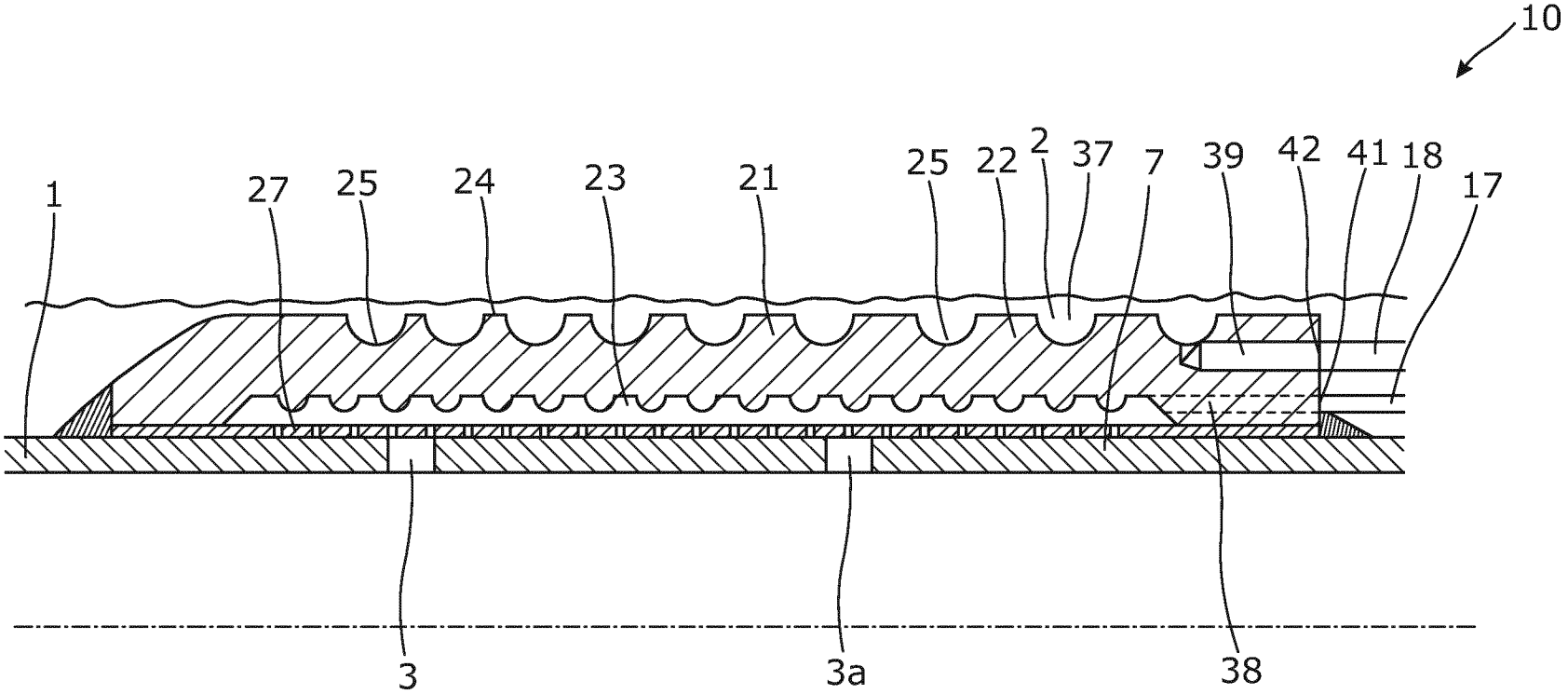
FIG. 6 shows a cross-sectional view of part of another annular barrier.

The collection part 21, shown in FIG. 6, furthermore serves to collect fluid into the second inlet 18. The collection sleeve 22 comprises circumferential grooves 25 in the outer sleeve face 24 of the collection sleeve 22 and longitudinal grooves 26 (shown in FIG. 7) joining the circumferential grooves 25, so that if the collection part 21 fills up most of the surrounding annulus 2, 37, the grooves in the outer sleeve face 24 of the collection part 21 form channels guiding the fluid into the second inlet 18. The collection part 21 thus has a first channel 38 from the annular chamber 23 to a first outlet 41 of the collection part 21, the first outlet 41 being fluidly connected to the first inlet 17 of the expansion unit. The collection part 21 furthermore has a second channel 39 collecting fluid from the grooves 25, 26 (shown in FIG. 7) in the outer sleeve face 24 and ending in a second outlet 42 being fluidly connected to the second inlet 18 of the expansion unit.

As shown in FIG. 6, the collection part 21 further comprises a filtering element 27 in the form of a slotted or perforated plate, arranged between the tubular metal part 7 and the collection sleeve 22 and configured to filtrate the fluid from inside the tubular metal part flowing in through the first and second expansion openings 3, 3*a*. The collection sleeve 22 and the filtering element 27 are welded to the tubular metal part 7.

Figure 7:
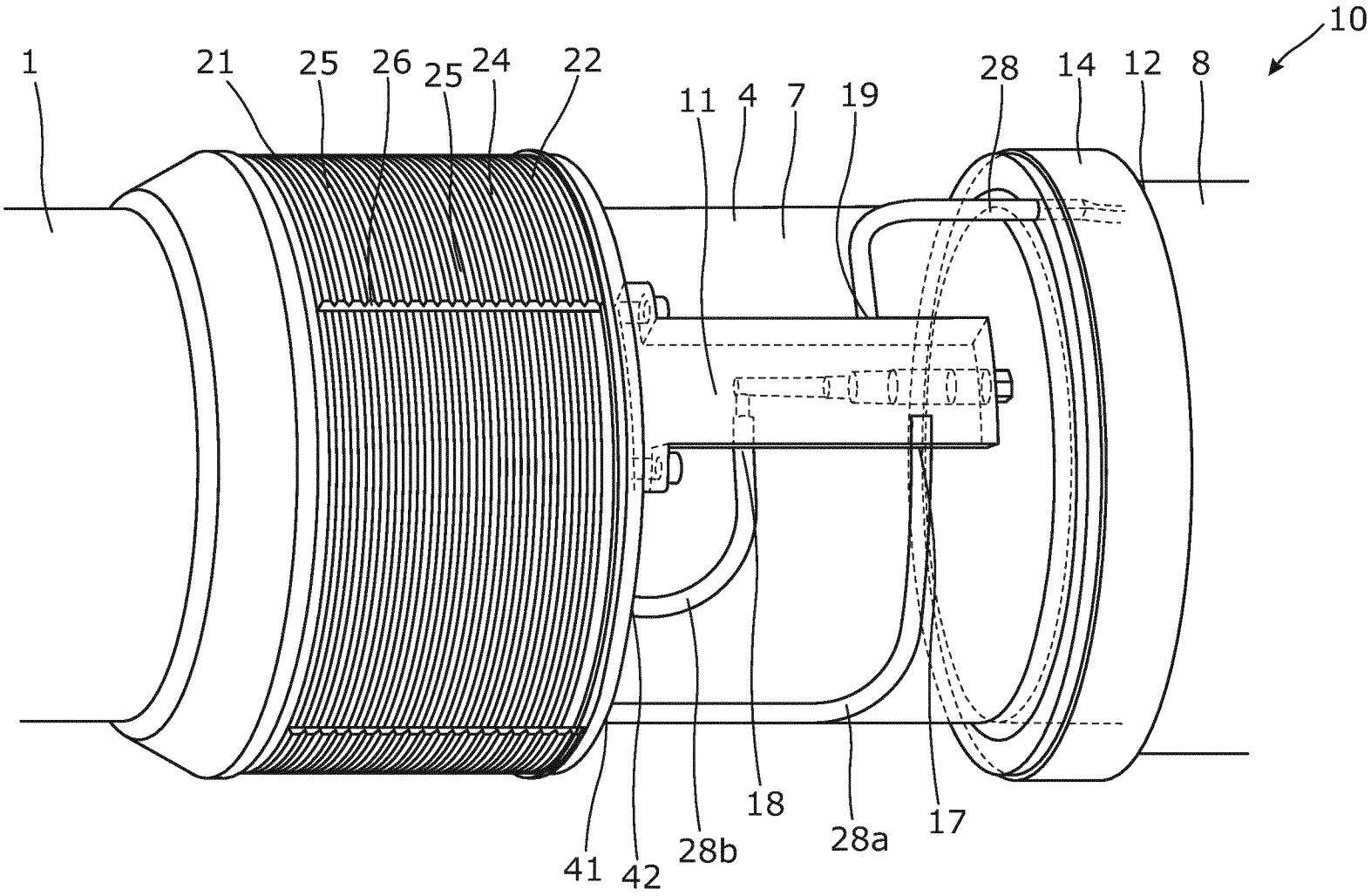
FIG. 7 shows part of an annular barrier in perspective having a collection unit.

FIG. 7 shows part of an annular barrier in perspective having an expansion unit 11 mounted on the outer face 4 of the tubular metal part 7 and between the collection part 21 and the connection part 14, which mounts one end 12 of the expandable sleeve 8. The collection sleeve 22 of the collection part has both circumferential grooves 25 and longitudinal grooves 26 joining the circumferential grooves 25. The first outlet 41 of the collection part 21 is fluidly connected to the first inlet 17 of the expansion unit 11 by means of a conduit 28*a*, and the second outlet 42 of the collection part 21 is fluidly connected to the second inlet 18 of the expansion unit 11 by means of a conduit 28*b*.

The expansion unit 11 is in FIG. 8 arranged so that the element 20 moves radially when moving back and forth between the first position and the second position. The expandable sleeve 8 has an expandable sleeve opening 31 opposite the expansion opening 3, and the expansion unit 11 is arranged both in the expansion opening 3 and the expandable sleeve 8 opening so that the outlet is arranged in the annular space. The element is a ball 20*b* movable between a first seat 48 when the element is in the first position and a second seat 49 when the element is in the second position. The outlet is arranged between the first seat and the second seat and in the annular space 15. The expansion unit may, in another embodiment, comprise a plurality of first inlets and/or a plurality of second inlets.

Figure 10:
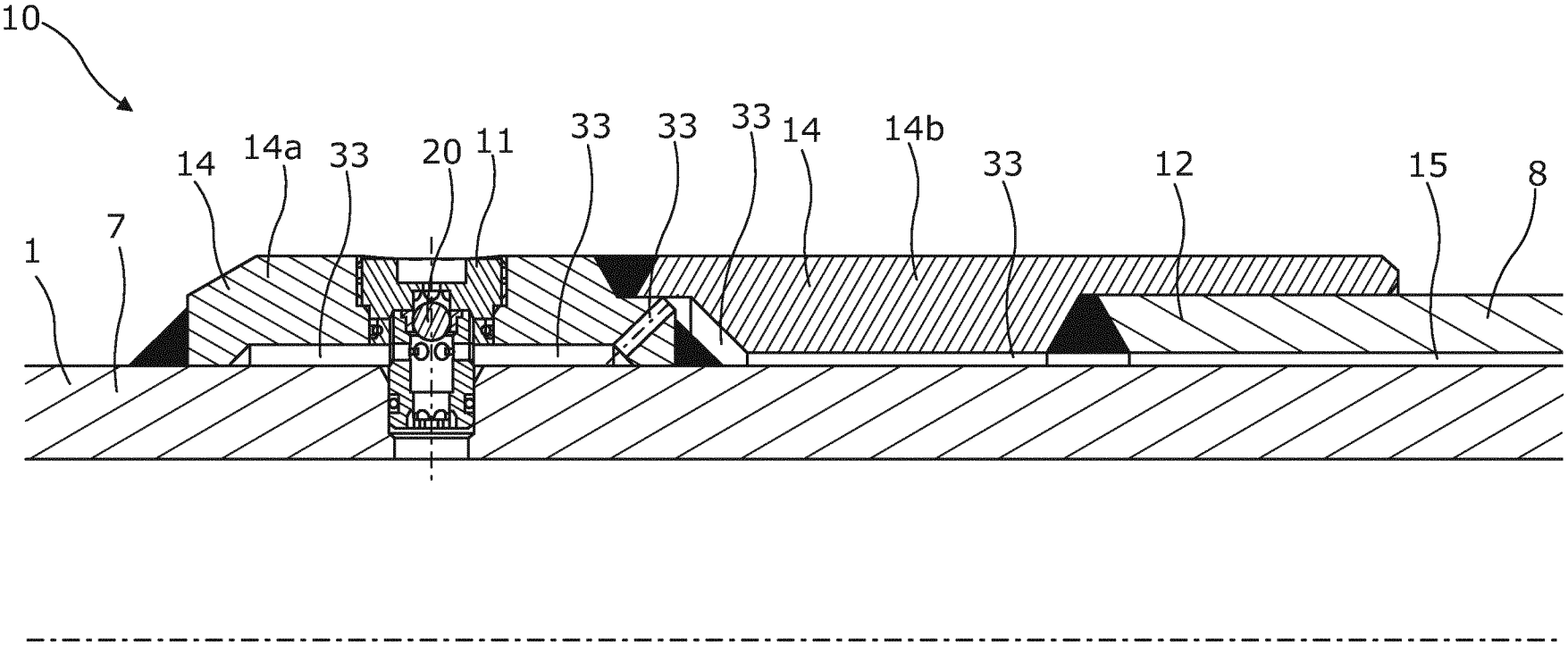
FIG. 10 shows another cross-sectional view of part of another annular barrier.

As shown in FIG. 10, the expansion unit 11 is, as in FIG. 8, arranged so that the element 20 moves radially when moving back and forth between the first position and the second position. The annular barrier further comprises a connection part 14, which mounts one end 12 of the expandable sleeve 8 to the tubular metal part 7. The connection part is mounted from a first part 14*a* and a second part 14*b*, the second part of the connection part being connected to the expandable sleeve 8. The first part 14*a* and the second part 14*b* of the connection part 14 comprise channels 33 fluidly connecting the inside of the tubular metal part 7 and the space 15 when the valve is fluidly connecting the inside of the tubular metal part 7 and the channels 33.

In another embodiment, the element 20 is a piston movable in a piston housing between the first position and the second position, the piston housing comprising a spring being compressed when the piston moves in a first direction.

Figure 9:
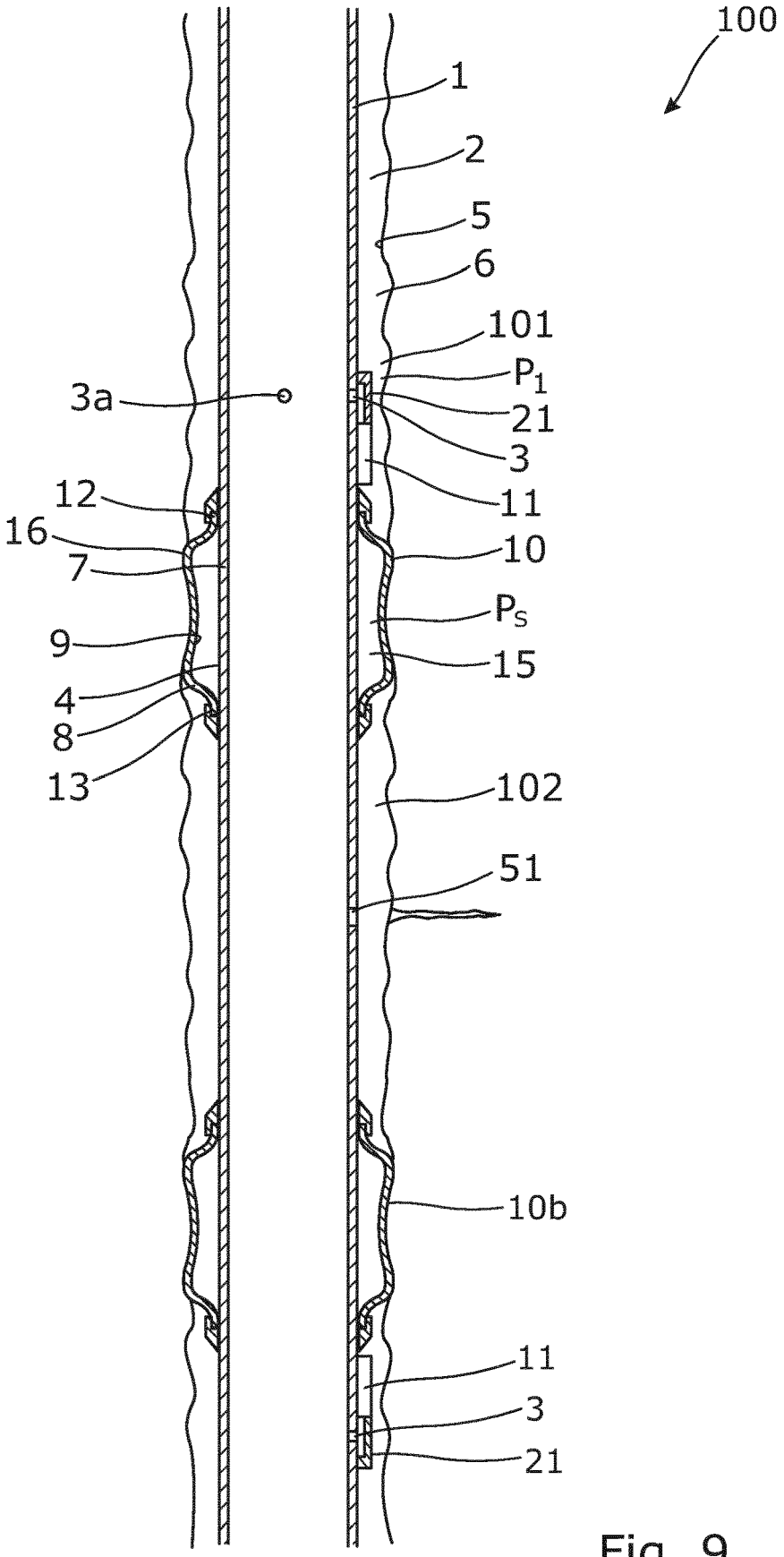
FIG. 9 shows a cross-sectional view of downhole system.

The invention further relates to a downhole system 100 comprising the well tubular structure 1, and the first annular barrier described above having an expansion unit as shown in FIG. 9. The downhole system may further comprise a second annular barrier 10*b* which, when expanded, isolates a production zone together with the first annular barrier 10. The expansion units 11 of the first annular barrier and the second annular barrier are arranged in a zone 101 other than the production zone 102.

The present invention also relates to an expansion method for providing and maintaining zone isolation between a first zone 101 having a first pressure $P_1$ and a second zone 102 having a second pressure of the borehole 6. The method comprises the steps of mounting an annular barrier 10 as described above as part of a well tubular structure, providing pressurised fluid in through the expansion opening(s), arranging the element in the first position, the first position being the expansion position, so that the pressurised fluid is allowed to flow into the annular space, expanding the expandable sleeve 8 of the annular barrier to provide zone isolation between the first zone and the second zone of the borehole, and maintaining zone isolation between the first zone and the second zone, when the first pressure of the first zone is higher than the space pressure, by arranging the element 20 in the second position, whereby the second inlet is in fluid communication with the outlet.

Even though not shown, the annular barrier 10 may also be arranged in a casing and may also be used as an anchor of the well tubular structure 1.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and a wall of a borehole downhole for providing zone isolation between a first zone having a first pressure and a second zone, the annular barrier comprising:

a tubular metal part for mounting as part of the well tubular structure, the tubular metal part having a first expansion opening, an axial extension and an outer face, an expandable sleeve surrounding the tubular metal part and having an inner face facing the tubular metal part and an outer face facing the wall of the borehole, each end of the expandable sleeve being connected with the tubular metal part, and an annular space between the inner face of the expandable sleeve and the tubular metal part, the annular space having a space pressure, wherein fluid inside the tubular metal part has a tubular pressure, and wherein the annular barrier comprises an expansion unit having a first inlet in fluid communication with the first expansion opening, a second inlet in fluid communication with the first zone and an outlet in fluid communication with the annular space, and the expansion unit comprising an element movable at least between a first position and a second position, in the first position the first expansion opening being in bilateral fluid communication with the outlet to equalize pressure in the tubular metal part with the space pressure when the tubular pressure is higher than the first pressure, and in the second position the outlet being in bilateral fluid communication with the first zone via the second inlet to equalize the first pressure in the first zone with the space pressure when the first pressure is higher than the tubular pressure, wherein the tubular metal part comprises at least one second expansion opening being fluidly connected with the first inlet, and wherein the space pressure is equalized with the greater momentary pressure of the first pressure and the tubular pressure at a first time, even if the space pressure at a second time later than the first time is less than the greater momentary pressure.

2. The annular barrier according to claim 1, wherein the expansion unit comprises a collection part fluidly connected to the first expansion opening and the second expansion opening.

3. The annular barrier according to claim 2, wherein the collection part comprises a collection sleeve arranged outside the tubular metal part and connected to the tubular metal part, forming an annular chamber between the tubular metal part and the collection sleeve.

4. The annular barrier according to claim 3, wherein the first expansion opening and the second expansion opening are fluidly connected to the annular chamber, and the first inlet is fluidly connected to the annular chamber.

5. The annular barrier according to claim 4, wherein one or more groove(s) are arranged in the collection sleeve and/or the tubular metal part facing the annular chamber.

6. The annular barrier according to claim 4, wherein the collection sleeve has an outer sleeve face in which one or more circumferential groove(s) is/are arranged.

7. The annular barrier according to claim 6, wherein the outer sleeve face has one or more longitudinal groove(s) along the axial extension.

8. The annular barrier according to claim 7, wherein the one or more longitudinal groove(s) is/are in fluid communication with the second inlet.

9. The annular barrier according to claim 4, wherein a filtering element, is arranged between the tubular metal part and the collection sleeve and configured to filtrate the fluid from inside the tubular metal part.

10. The annular barrier according to claim 1, wherein the expansion unit comprises a shuttle valve and the element of the expansion unit is comprised in the shuttle valve.

11. The annular barrier according to claim 10, wherein the element of the expansion unit moves in the axial extension or radially perpendicular to the axial extension.

12. The annular barrier according to claim 1, wherein the element is a ball movable between a first seat when the element is in the first position and a second seat when the element is in the second position.

13. A downhole system comprising:

a well tubular structure, and a first annular barrier according to claim 1.

14. The downhole system according to claim 13, further comprising a second annular barrier which, when expanded, isolates a production zone together with the first annular barrier, the expansion units of the first annular barrier and the second annular barrier being arranged in a zone other than the production zone.

* * * * *